US005374869A

United States Patent [19]

Bowen et al.

[11] Patent Number: 5,374,869

[45] Date of Patent: Dec. 20, 1994

[54] CIGARETTE SYSTEM

[75] Inventors: Larry Bowen, Orangeville, Canada; Warren A. Brackmann, Collins, Mo.; Norman Cohen, Scarborough, Canada; George Fazekas, Thornhill, Canada; Joseph Heffernan, Toronto, Canada; Peter P. Kaczmarek, Richmond Hill, Canada; Stanislav M. Snaidr, Mississauga, Canada

[73] Assignee: Rothmans, Benson & Hedges Inc., North York, Canada

[21] Appl. No.: 968,590

[22] Filed: Oct. 29, 1992

[30] Foreign Application Priority Data

Oct. 30, 1991 [GB] United Kingdom ..... 9122935

[51] Int. Cl.[5] ..... A24D 1/02

[52] U.S. Cl. ..... 313/331

[58] Field of Search ..... 131/194, 331

[56] References Cited

U.S. PATENT DOCUMENTS

| | | | |
|---|---|---|---|
| 4,319,587 | 3/1982 | Moser | 131/270 |
| 4,328,817 | 5/1982 | Naylor et al. | 131/360 |
| 4,452,259 | 6/1984 | Norman et al. | 131/349 |
| 4,637,410 | 1/1987 | Luke | 131/361 |
| 4,739,775 | 4/1988 | Hampl, Jr. | 131/360 |
| 4,838,286 | 6/1989 | Phelstead | 131/360 |
| 4,893,638 | 1/1990 | Lauterbach | 131/364 |
| 4,924,888 | 5/1990 | Perfetti et al. | 131/336 |
| 5,033,484 | 6/1991 | Seidel et al. | 131/364 |
| 5,072,743 | 12/1991 | Perrine | 131/360 |
| 5,105,839 | 4/1992 | Case et al. | 131/365 |

FOREIGN PATENT DOCUMENTS

| | | |
|---|---|---|
| 0365882 | 5/1990 | European Pat. Off. . |
| 2063050 | 6/1981 | United Kingdom . |
| 2149287 | 6/1985 | United Kingdom . |
| 2175789 | 7/1988 | United Kingdom . |

OTHER PUBLICATIONS

Keith et al., "Quantitative Studies on Cigarette Smoke", Tobacco Science, 1957, pp. 51 to 57.

"Camels" Advertisement—1939.

"Pall Mall" Advertisement—1951.

*Primary Examiner*—Theatrice Brown

*Attorney, Agent, or Firm*—Sim & McBurney

[57] ABSTRACT

A novel cigarette is described which has a greater number of puffs, at least about 2 more, preferably at least about 4 more and more preferably at least about 6 more, than a conventional cigarette of same dimensions and length of tobacco rod. The cigarettes may be partially smoked, extinguished, stored and then resmoked. The greater-than-normal number of puffs may be achieved by employing a slower burning tobacco blend, a lower draw resistance tobacco, a greater tobacco density and/or a burn rate retardant wrapper.

65 Claims, No Drawings

CIGARETTE SYSTEM

FIELD OF INVENTION

The present invention relates to a novel cigarette structure which permits individual cigarettes to be partially smoked, extinguished and then re-smoked, in a unique manner, or completely smoked as a long-lasting cigarette.

BACKGROUND TO THE INVENTION

Normally, cigarettes are manufactured to be wholly consumed by the smoker once lit. When smoking such cigarettes, the smoker takes a number of puffs on the cigarette. For most smokers, smoking of a single cigarette with around 7 to 12 puffs, depending on the tobacco rod length, provides the desired smoking pleasure.

A prior art patent search has been effected with respect to the subject matter of this application and, as a result, the following United States patents have been located as potentially-relevant prior art:

| | |
|---|---|
| 4,319,587 | 4,893,638 |
| 4,328,817 | 4,924,888 |
| 4,452,259 | 5,033,484 |
| 4,637,410 | 5,072,743 |
| 4,739,775 | 5,105,839 |
| 4,838,286 | |

In addition, the following prior art has been drawn to the applicants attention:

| | |
|---|---|
| U.K. 2,063,050 | U.K. 2,149,287 |
| U.K. 2,175,789 | E.P. 0,365,882 |

Of this prior art, U.K. 2,149,287 is equivalent to U.S. Pat. No. 4,838,286 cited above, U.K. 2,175,789 is equivalent to U.S. Pat. No. 4,893,638 cited above and U.K. 2,063,050 is equivalent to U.S. Pat. No. 4,328,817 cited above.

Certain of this prior art discloses attempts to provide cigarettes which are intended to be consumed for part of the tobacco rod, extinguished and relit, as described, for example, in U.S. Pat. Nos. 4,319,587, 4,452,259, 4,739,775 and 5,072,743. However, such cigarettes otherwise are conventional in character. A variety of parameters which are conventional in cigarettes are described, for example, in U.S. Pat. Nos. 4,924,888, 5,033,484 and 5,105,839, although such references describe various manipulations to achieve the effects described therein.

U.S. Pat. Nos. 4,637,410 and 4,893,638 describe cigarettes which have a smaller-than-normal circumference to provide a slim cigarette appearance. U.S. Pat. No. 4,893,638 describes employment of a very high packing density for tobacco in a filler rod of ground tobacco.

None of the patent prior art referred to above discloses or suggests the provision of the actual combination of parameters described below which enables the provision of a cigarette having a greater-than-normal number of puffs.

The applicants are aware of unfiltered cigarettes made in Russia and known as "Papirossy", which employ a high density of tobacco in a relatively-short tobacco rod and which exhibit a low burn rate, which might be expected to lead to a high number of puffs.

However, such cigarettes self-extinguish under the standard smoking conditions described below.

As described below, the various smoking parameters, including puff count for a cigarette, are determined according to the current tobacco industry standards in effect at the time of filing this application. Certain of these standards have changed with time and the standard in effect in 1957 for determining puff count is described in an article by Keith et al. entitled "Characteristic Studies on Cigarette Smoke" Tobacco Science, 1957, pp. 51 to 57. When a conventional cigarette and cigarettes constructed in accordance with the invention were smoked according to the two procedures, namely the current standard smoking procedure (ISO) and the former standard smoking procedure, then the puff count which resulted from using the current standard was, on average, 67% of the puff count which resulted from using the former standard.

The data presented in the Keith et al. article indicates that, on average, 12 puffs (determined at the standard described therein) were obtained for 40.2 mm smoked length (i.e. 29.8 mm butt length from a 70 mm cigarette length) of an unfiltered cigarette. By applying the 67% ratio referred to above, the 12 puffs translates into 8.04 ISO puffs for 40.2 mm smoked length, which converts to 9.4 ISO puffs for 47 mm smoked tobacco rod length (the ISO standard for a filter cigarette of 55 mm tobacco rod length). The ISO puff count corresponds to a linear burn rate (as the term is defined below) of 5.0 mm/min, a value greater than the maximum value described herein.

A prior attempt has been made to provide a slower burning cigarette with more puffs per cigarette. In this regard, "Camel" brand cigarettes, available in the United States in the late 1930's and early 1940's, were advertised as containing a greater tobacco weight than then-conventional cigarettes and as being a slower burning cigarette which gives a 25% greater number of puffs than a conventional cigarette.

If the comparison made in the "Camel" cigarette advertising is considered in terms of the smoking data provided by Keith et al., then the 25% more puffs referred to in the advertising materials corresponds to 11.75 ISO puffs for the "Camel" cigarettes. As described in more detail below, the cigarettes of the invention have a greater number of puffs than those for the "Camel" cigarettes.

The applicants are aware of an advertisement from 1952, claiming that an unfiltered cigarette having the brand name "Pall Mall", available in the United States, has 17 puffs. The advertisement compares a cigarette having an approximately 85 mm rod length for the "Pall Mall" cigarette with a 70 mm rod length for the conventional cigarette. The longer "Pall Mall" cigarette is indicated to have the same 17 puff count as the normal-length cigarette. However, no manner of determining the number of puffs described in the advertisement is specified but, since the number is indicated to be that for a conventional cigarette, the stated number of puffs would seem to have been determined in a manner different from the procedure described in the Keith et al. article, which would indicate that the "Pall Mall" cigarette possessed no more than 14 puffs for 47 mm smoked length, as determined by the older standard and hence no more than 9.4 puffs by the current standard. In fact, historical data indicated that this "Pall Mall" cigarette had 8.5 ISO puffs for a 47 mm smoked length.

Neither of these prior art cigarettes, i.e. the "Camel" and "Pall Mall" cigarettes, was intended to be consumed other than at one time, in contrast to the present invention, in which the novel cigarettes are intended to be smoked, extinguished and relit for a second smoking at a subsequent time. These prior art cigarettes are considered to be "conventional", as the term is employed herein, as being a cigarette regularly-available in the market-place at the relevant time.

The applicants also suspect that perhaps some so-called "roll-your-own" smokers, that is, persons who make for themselves at home or the like cigarettes from papers or tubes and loose tobacco, may have on occasion achieved sufficiently high tobacco densities as to provide a large number of puffs. However, such cigarettes have a significant variability of parameters not evident in a factory-made cigarette and it is not possible to obtain such cigarettes in order to ascertain their burn characteristics under the existing standard smoking conditions, in particular, whether such cigarettes may self-extinguish.

In connection with the establishment of the parameters defined below for the novel cigarette described herein, several characteristics of commercial cigarettes have been considered, particularly for cigarettes available on the Canadian market over the past 24 years, including puff count, linear burn rate and free burn rate (as the terms are defined below), and, of all the cigarettes considered, the slowest burning commercial cigarette exhibited a linear burn rate of 4.43 mm/min. and a free burn rate of 4.2 mm/min., both values greater than the maximum values employed herein for the novel cigarettes of the invention. This commercial cigarette exhibits a standard number of puffs, namely 10.6 for a 55 mm tobacco rod length, but employs a very high level of ventilation of 68%, which accounts for the closeness of the linear and free burn rate values.

As will be seen from the description below, one parameter which is employed in providing the novel cigarette of the invention is the employment of a density of tobacco higher than that conventionally employed in commercial cigarettes. The employment of such higher density herein is the reverse of a trend by the cigarette industry over many years to find ways to decrease the weight of tobacco contained in cigarettes. One problem that employment of a higher density of tobacco produces is a corresponding increase in draw resistance. As will be seen from the detailed description of this invention, the problem of increased draw resistance has been overcome by employing a particular type of blend of tobacco in the rod.

SUMMARY OF INVENTION

The present invention is concerned with the provision of a novel commercial cigarette structure which provides a greater-than-normal number of puffs to a smoker when lit than a conventional commercial cigarette and yet comprises a tobacco rod of the same physical dimensions as a conventional commercial cigarette providing the normal number of puffs. The novel cigarettes of the invention, in broad aspects and specific embodiments thereof, are formed from certain tobaccos, tobacco blend components, cigarette papers and tobacco smoke filters normally found or otherwise known in the tobacco industry, but manipulated and utilized in unique manners, as described in more detail below, so as to provide a greater number of puffs than heretofore available in a conventional commercial cigarette.

Accordingly, in one aspect of the present invention, there is provided a non-self-extinguishing factory-made cigarette which has at least about 2 more puffs than the median number of puffs of a conventional cigarette of the same dimensions of length and diameter of tobacco rod.

By increasing the number of puffs a smoker can take from a cigarette of specific length and diameter of tobacco rod, the smoker is provided with a greater overall smoking time from a single cigarette. Further, the greater overall smoking time permits the smoker to smoke the cigarette part of the way through, extinguish the cigarette and then relight it at a later time to smoke the remainder of the cigarette, thereby, in effect, obtaining two smokings from a single cigarette. The cigarette also may be smoked as a cigarette which has a greater-than-normal number of puffs.

In a preferred embodiment of the invention, the number of puffs obtained from a cigarette is approximately doubled with respect to a conventional commercial cigarette containing a tobacco rod of the same physical dimensions. This cigarette arrangement permits the smoker to take the normal number of puffs that would be obtained from a conventional cigarette of the same rod dimensions, extinguish the cigarette and then relight the cigarette at a later time to smoke the cigarette, again for the number of puffs that would be obtained from a conventional cigarette of the same original tobacco rod dimensions. In this embodiment of the invention, it is preferred that the smoking characteristics of the cigarette be substantially identical during both the first and second smokings of the cigarette. The cigarette also may be smoked as a cigarette having double the number of puffs than normal.

In another aspect of the invention, there is provided a non-self-extinguishing factory-made cigarette having at least about 14 puffs, preferably about 15 to about 25 puffs. Such number of puffs is greater than the number of puffs that is obtained from any commercial cigarette known to the applicants.

In a further aspect of the present invention, there is provided a non-self-extinguishing factory-made cigarette comprising a tobacco filler rod enclosed within a paper wrapper and a filter at one end and having the following combination of parameters:

a draw resistance of less than about 20 cm $H_2O$, and a free burn rate of blend in the tobacco rod of no more than about 4 mm/min., preferably no more than about 3.5 mm/min.

This combination of draw resistance and free burn rate of blend in a filtered cigarette is not present in any commercial cigarette known to the applicants.

DEFINITIONS

This disclosure and the claims appended hereto employ certain terminology, the meanings of which are those evident to a person skilled in the tobacco art as of the date of filing of this application. In particular, as used herein, the terms:

"non-self-extinguishing" cigarette means a cigarette, which, when smoked on a smoking machine according to the industry smoking standards (I.S.O. #3308 and #4387), does not become extinguished but rather remains lit throughout such smoking.

"factory-made" cigarette means a cigarette has been made on a continuous cigarette-making machine wherein a continuous tobacco rod is formed by moving a rod-forming surface transverse to the flow of a shower of tobacco particles, a continuous cigarette rod is formed from the continuous tobacco rod by wrapping in cigarette paper and individual lengths of the continuous cigarette rod are severed. A tobacco smoke filter may be attached to the individual lengths. Such cigarettes generally are characterized by a tobacco rod in which the tobacco is substantially uniformly distributed.

"puffs" is determined by the number of puffs obtained by a cigarette according to the invention when smoked on a smoking machine according to the industry smoking standards (I.S.O. #3308 and #4387), and "more puffs" is that as compared to a conventional cigarette of same dimensions of length and diameter of tobacco rod smoked under the same conditions.

"free burn rate" (otherwise known as the rate of free combustion) refers to the burn rate of the tobacco blend employed in a cigarette, when a cigarette is smoked on a smoking machine according to the industry smoking standard (I.S.O. #3612) expressed in mm/min. The free burn rate of a tobacco blend in a tobacco rod is determined at a rod draw resistance of 8 cm $H_2O$ for a tobacco rod having a circumference of 25 mm and a length of 64 mm wrapped in a standard cigarette paper known as "KC119".

"linear burn rate" (otherwise known as the rate of puffed combustion) refers to the burn rate of a cigarette when a cigarette is smoked on a smoking machine according to the industry smoking standards (I.S.O. #3308 and #4387), expressed in mm/min.

"conventional cigarette" means a non-self-extinguishing factory-made cigarette which is of conventional dimensions and parameters for the local cigarette market. For example, in North America, conventional cigarettes generally have a cigarette circumference of from about 20 to 30 mm, usually about 23 to 27 mm, and a tobacco rod length of at least about 40 mm, generally one of three standard tobacco rod lengths, namely about 55 mm, about 64 mm and about 74 mm, and which has an acceptable draw resistance. When a tobacco smoke filter is provided with such cigarette, such filter usually has a length of from about 15 to 35 mm.

"draw resistance" means the draw resistance through an unlit cigarette, as determined by the industry smoking standard No. 6565, and is expressed in cm of water ($H_2O$) at an air flow rate of 17.5 cc/sec.

"porosity" with respect to the porosity of a wrapping surrounding a tobacco rod in a cigarette is expressed in Coresta Units (CU).

GENERAL DESCRIPTION OF INVENTION

The cigarettes provided in accordance with the present invention are non-self-extinguishing in the ISO smoking test described elsewhere herein. The main elements determining that the cigarette remains in a lit condition throughout the smoking test are the wrapper surrounding the tobacco rod and the tobacco blend in the tobacco rod and its characteristics, as described below. It is possible to design a cigarette such that either or both of these elements result in the cigarette becoming extinguished during the smoking test, for example the Papirossy cigarettes mentioned above. Such self-extinguishing cigarettes are not included within the scope of the invention.

The cigarettes provided in accordance with the present invention are commercial cigarettes, that is factory-made, and hence possess a uniformity of distribution of tobacco strands along the length of the cigarette, in contrast to hand-made or "roll-your-own" cigarettes, where such uniformity generally is not achieved in view of the nature of the assembly procedure.

In one broad aspect, the present invention provides a cigarette which has a greater-than-normal number of puffs from a cigarette having a tobacco rod of the same dimensions of length and diameter as a conventional cigarette, specifically about 2 more puffs than the median number of puffs for a conventional cigarette. Preferably, the novel cigarette has at least about 4 more, more preferably at least about 6 more puffs, than the median number of puffs for a conventional cigarette.

Conventional factory-made cigarettes in North America and elsewhere generally have a circumference of about 23 to 27 mm and a length of tobacco rod of about 55 mm, 64 mm or 74 mm. With these dimensions, conventional cigarettes generally provide about 7 to 10, 8 to 11 and 10 to 12 puffs for the respective rod lengths, when smoked by a smoking machine under I.S.O. conditions of 35 cc puffs of two second duration every minute down to a residual unsmoked tobacco rod length of 8 mm (i.e. ISO #'s 3308 and 4387). Accordingly, for a 64 mm length tobacco rod, 56 mm is consumed by the smoking machine. The cigarettes of the invention for the same dimension have at least about 2 more puffs than the median number of puffs for the conventional cigarettes, most preferably double the number of puffs. Depending on the length of tobacco rod, the cigarettes according to the invention may have at least about 14 puffs, preferably about 15 to about 30 puffs.

The greater number of puffs of the cigarette of the invention is provided by a cigarette having a linear burn rate which is slower than that for a conventional cigarette. Generally, a cigarette provided in accordance with the invention exhibits a linear burn rate of no more than about 4 mm/min. The linear burn rate of the cigarette generally exceeds the free burn rate of the tobacco rod by an amount which varies with variations in factors of influencing linear burn rate but not free burn rate, notably dilution of the cigarette smoke. In general, for the same cigarette, manipulations of the components of the cigarette described below to alter the free burn rate bring about a corresponding variation in the linear burn rate of the cigarette.

As mentioned above, a cigarette provided in accordance with the present invention generally has at least about 14 puffs. For a 64 mm tobacco rod length of 23 to 27 mm circumference, the number of puffs preferably is about 15 to about 23, more preferably about 16 to 18 puffs. For a 74 mm tobacco rod length, the number of puffs is at least about 14, preferably about 15 to about 30, more preferably about 17 to 25 puffs. Similarly, for a 55 mm tobacco rod length, the number of puffs is at least about 14, preferably about 14 to about 22 puffs, more preferably about 14 to 16 puffs. The range and preferred number of puffs for a cigarette of other linear and circumferential dimensions can be readily determined by a person skilled in the art.

It is important that any cigarette, including those provided in accordance with the present invention, have a draw resistance which is acceptable to a smoker of the cigarette, so that the cigarette can be smoked.

Acceptability levels with respect to draw resistance vary according to particular consumer acceptance, but generally the draw resistance for a filtered cigarette provided in accordance with this invention is less than about 20 cm $H_2O$. A filtered cigarette according to the present invention preferably has a draw resistance of about 7 to about 15 cm $H_2O$, which is a level acceptable to smokers in North America, more preferably towards the upper end of this range.

The greater-than-normal number of puffs cigarette provided in accordance with this invention and having the above-described characteristics may be provided by manipulation of the components of a conventional cigarette. As noted earlier, the components of the tobacco blend and the characteristics of tobaccos used therein are themselves known and conventionally employed in cigarettes, but are employed herein in a unique manner to provide the cigarette of the invention.

One manipulation of the components of a conventional cigarette employed herein is to utilize a tobacco blend in the tobacco rod which is relatively slow burning in comparison to that employed in a conventional cigarette, specifically one having a free burn rate which is no more than about 4 mm/min, preferably no more than about 3.5 mm/min. A tobacco blend having such a slow free burn rate may be formed predominantly from tobaccos which inherently possess a low free burn rate, and such tobaccos are known to those skilled in the art. Such slow free burn rate tobaccos normally also would be present in a conventional cigarette blend but with higher free burn rate tobaccos providing the generally higher overall free burn rate of conventional tobacco rods.

The free burn rate of the tobacco blend should be at least at a level which maintains the cigarette lit, and hence the cigarette is not self-extinguishing. A cigarette of the invention of any desired dimension and pressure drop characteristic of tobacco rod may be provided employing a slower-burning rate tobacco blend which has a free burn rate which corresponds to a free burn rate having the values noted above under the recited standard conditions.

A free burn rate of tobacco blend within the range employed herein also may be achieved by providing a tobacco blend having a relatively low filling power, which may be achieved by employing tobacco strands which are predominantly denser, which contributes to a low draw resistance. A tobacco blend having such a low filling power may be formed predominantly from tobaccos which inherently possess a low filling power and such tobaccos are known to those skilled in the art. Such low filling power tobaccos normally also would be present in a conventional cigarette blend but with higher filling power tobaccos providing the generally higher overall free burn rate of conventional cigarette rods.

The provision of a cigarette in accordance with the invention having the required number of puffs and generally having a linear burn rate of no more than about 4 mm/min. of the tobacco rod and a free burn rate of tobacco rod no more than about 4 mm/min. further may be achieved by significantly increasing the density of the tobacco blend contained in the tobacco rod of the cigarette. Tobacco densities in conventional cigarettes generally range from about 170 to about 280 mg/cc. In the novel cigarettes of the present invention, the tobacco density may be at least about 300 mg/cc, preferably about 320 to about 400 mg/cc. Increasing the density of tobacco in the tobacco rod necessarily increases the draw resistance, so that the practical upper limit of tobacco density which can be employed is the level at which the draw resistance becomes unacceptable. By employing relatively low filling power tobaccos in the tobacco rod, as described above, the relatively higher density of tobacco may be employed in the tobacco rod while retaining an acceptable draw resistance.

In a preferred embodiment of the invention, therefore, there is provided a cigarette having the linear burn rate of no more than about 4 mm/min. and a draw resistance of less than about 20 cm $H_2O$ and a tobacco rod having a free burn rate of less than about 4 mm/min. and a tobacco density of at least about 300 mg/cc.

In addition to the slower-than-normal free burn rate discussed above, the blend of tobacco which is employed to provide the tobacco rod for the cigarette may be one from which tobacco stem has been eliminated or at least the proportion of tobacco stem decreased with respect to a blend employed to make a conventional cigarette. In this regard, conventional tobacco blends generally contain about 20 wt % of tobacco stem material. Processed tobacco stem generally tends to have a lower density than cut tobacco leaf and hence generally tends to burn at a faster rate. Such processed tobacco stem may comprise enhanced stem or expanded stem. Removal of the tobacco stem component from the tobacco blend, therefore, decreases the overall burn rate. In addition, the burn rate of tobacco may be retarded by decreasing the proportion of or by eliminating expanded tobacco in the tobacco blend. In this regard, conventional tobacco blends often contain from about 1 to about 30 wt % of expanded tobacco.

The tobacco from which the blend is formed may be any convenient tobacco type and may comprise flue-cured (or "Virginia" tobacco) or air-cured tobacco, Oriental tobacco, or mixtures thereof, depending on the local custom and convention. In general, the type of tobacco from which the cigarette for the invention is formed for any particular market may comprise the same type of tobacco as conventionally used in cigarettes for that market, with the modifications noted above to the tobacco present in the blend of such tobacco type or types to provide the greater-than-normal number of puffs. For example, for the Canadian market, the blend is comprised substantially or entirely of flue-cured tobacco.

One or both of the higher density of tobacco and retarded burn rate tobacco blend discussed above to achieve a higher-than-normal puff cigarette according to the invention may be employed in conjunction with conventional cigarette paper or, preferably, with a wrapping which retards the burn rate in comparison to a conventional cigarette. Such a wrapping may be provided by a single wrapping of a slow-burning cigarette paper or by multiple paper wrappings, one or more of which may be provided by a slow burning paper.

An advantage that the provision of a slow burning wrapping which retards the normal burn rate of a cigarette provides is that the quantity of tobacco consumed by burning between puffs is decreased in comparison to a conventional cigarette, even though substantially the same quantity of tobacco is consumed in each puff as in the conventional cigarette. This effect further enhances the ability to provide more puffs from the cigarette, as compared to a conventional cigarette.

The wrapping which is employed in the cigarette of the invention may be one which has a burn rate corresponding to that of a single cigarette paper of porosity of about 5 to about 50 Coresta Units, preferably slower burning papers having a porosity of about 5 about 20 CUs. Such wrapping may comprise a single cigarette paper having the recited burn rate or a multiple layer wrapping having the equivalent burn rate, as noted above.

In the present invention, therefore, a commercial cigarette having unique smoking characteristics provided, namely one having a greater number of puffs, preferably at least about 17 puffs for 56 mm length of tobacco rod consumed, than a conventional commercial cigarette having a tobacco rod of the same dimensions. Such smoking characteristics may be achieved in any convenient manner by employing one or a combination of features, such as those described above, namely low draw resistance tobacco, high tobacco density, slow burning cigarette paper, multiple paper wrapping, slow burning tobacco blend and/or reduction or elimination of enhanced or expanded tobacco stem or expanded tobacco from cut tobacco filler in the blend.

In a preferred embodiment of the invention, there is provided a non-self-extinguishing factory-made cigarette comprising a tobacco rod enclosed within a single cigarette paper wrapper and a filter at one end and having the following combination of parameters:

- a draw resistance of less than about 15 cm $H_2O$
- a tobacco density in the tobacco rod of about 320 to about 400 mg/cc
- a free burn rate of blend in the tobacco rod of no more than about 3.5 mm/min
- a linear burn rate of cigarette of no more than about 4 mm/min
- a circumference of about 23 to 27 mm
- a tobacco rod length of about 60 to 70 mm
- about 16 to about 18 puffs and wherein the single cigarette paper wrapper has a porosity of about 5 to about 20 Coresta Units. In such a cigarette, the tobacco rod preferably is comprised substantially of flue-cured tobacco.

In a conventional cigarette, the amount of tar, nicotine and flavour increases in subsequent puffs as the cigarette is consumed. This effect may be accentuated when a cigarette as described above, with a higher-than-normal number of puffs, and in particular one having approximately twice as many puffs, is provided. However, a cigarette according to the invention may be constructed so that the rate of increase of tar, nicotine and flavour delivered to the smoker is slower than the rate of increase for a conventional cigarette as smoking progresses, so that the per-puff profile of delivery of tar, nicotine and flavour from a cigarette according to the invention exhibits a flatter curve than the per-puff profile of such delivery from a conventional cigarette. In addition, a cigarette according to the invention may employ a tobacco blend which delivers a level of tar land nicotine per puff which is approximately that of a conventional cigarette.

In a preferred embodiment of the invention, the per-puff smoke delivery profile of the cigarette to a smoker may be altered to provide a more uniform delivery of tar, nicotine and flavour to the smoker from the cigarette than otherwise would be the case. Such more uniform delivery may be achieved by effecting suitable dilution of normal cigarette smoke, such as by ventilation air. Alternatively, or in conjunction with dilution, such more uniform delivery may be achieved by suitable filtration of normal cigarette smoke.

One technique which may be employed to achieve the more uniform delivery profile of tar, nicotine and flavour is to adjust the dilution of the smoke by adjusting the amount of air mixed with the smoke as smoking of the cigarette progresses. Increased ventilation results in increased dilution of the tobacco smoke, and hence of the components of the smoke, entering the smoker's mouth.

The provision of adjustable dilution is particularly convenient when the cigarette is intended to be smoked in two smokings, wherein the cigarette is smoked for an initial length thereof and extinguished to be subsequently relit and smoked for a further length thereof. The level of dilution of the tobacco smoke may be altered from an initial level during the first smoking to a second higher level in the second smoking, so that, overall, the per-puff smoke delivery profile to the smoker is approximately the same for both smokings of the cigarette. However, any other means of providing a smoke delivery profile which is approximately the same for both smokings of the cigarette may be employed.

The dilution may be varied from a first lower level of dilution of from 0 to about 40% dilution of tobacco smoke to a second higher level of dilution of from about 10 to about 60% dilution of tobacco smoke. Alternatively, the dilution may be adjusted continuously during smoking of the cigarette, particularly to provide a substantially uniform delivery of smoke components to the smoker during smoking of the complete cigarette.

Adjustment to dilution conveniently may be achieved by employing a manually-adjustable ventilation filter, so that the smoker can adjust the ventilation by air during smoking of the cigarette to compensate for changes in smoking characteristics. In general, such manually-adjustable filter may comprise elements which rotate relative to one another between extremities defining lower and upper limits of air ventilation of smoke passing through the filter, usually with a continuous or step-wise increase in ventilation as the elements are rotated relative to one another between the rotational extremities defining the lower and upper limits of ventilation. Alternatively, an air-ventilated filter which may be constructed so as to be self-adjusting with respect to dilution during smoking, may be employed.

A variety of structures have been proposed to provide for variable ventilation of cigarette filter elements and, in this regard, reference may be made to U.S. Pat. Nos. 4,700,725, 4,699,158, 4,687,008, 4,677,995, 4,646,763, 4,601,298, 4,600,027, 4,570,649, 4,526,183, 4,532,943 and 4,433,696, all assigned to Philip Morris Inc. A number of other filter structures of other entities have been proposed. One or more of such structures may be employed as the variable ventilation filter herein.

A further technique which may be employed to alter the constitution of the smoke and to achieve the more uniform per-puff delivery profile is adjustment to the blend of tobaccos in the cigarette cross-section along the length of the cigarette, to provide a milder blend of tobacco in later puffs, as described in U.S. Pat. No. 4,896,681 ("Vari-Blend"), assigned to the applicant herein and the disclosure of which is incorporated herein by reference.

Another technique to alter the constitution of the smoke and to achieve the more uniform per-puff delivery profile is adjustment of the level of filtration of components from the tobacco smoke as smoking progresses. This result may be achieved by replacing a conventional filter by a more highly efficient filter or by adding an additional filter element. A self-adjusting filter may be employed to achieve this result, such as described in copending U.S. patent application Ser. No. 752,595 filed Mar. 1, 1990 ("Vari-Filter"), assigned to the assignee hereof and the disclosure of which is incorporated herein by reference, as may a manually-adjustable filter.

These techniques, namely adjustment of filtration, adjustment of dilution, increasing levels of filtration and blend variation, may be combined, as required, to provide the desired per-puff delivery of tar, nicotine and flavour to the smoker. Using such techniques, it is possible to achieve an approximately conventional delivery for tar, nicotine and flavour within a first smoking of the cigarette, as well as a reduced increase in the tar, nicotine and flavour in subsequent puffs in a second smoking of the cigarette. In this way, during both smokings of the cigarette, there is delivered to the smoker conventional levels of tar and nicotine per puff.

When a cigarette constructed as described herein is smoked, extinguished and then smoked again, the mouth end of the filter may be stained with smoke deposits after the first segment has been smoked. Such staining may be considered undesirable by the smoker and inhibiting to smoking the cigarette again. Another feature of the invention is to provide means to obscure, fully or partially, the stain caused by the initial smoking of the cigarette from the smoker. This result may be achieved by employing a filter which is recessed at the mouth end of the filter, optionally with baffles and vanes.

A partially-smoked and extinguished cigarette possesses a burnt odour, charred tobacco and ash, which may adversely affect the smoking quality of other cigarettes in a package, if a partially-smoked and extinguished cigarette is placed in the pack for storage for later smoking. A further feature of the invention provides means to eliminate or obscure the effects of a partially-smoked and extinguished cigarette from the remainder of the cigarettes in the pack.

One construction providing such means employs a separate compartment in the cigarette package containing a rack or other suitable receptacle provided therein into which lighted cigarettes can be inserted, extinguished, held and stored for subsequent reuse.

Alternatively, a cap may be provided, which slips over the lit end of the cigarette and locks into place to enclose fully and extinguish the lit end of the cigarette. A further alternative is to provide an enclosure which wholly encloses the partially-smoked cigarette, to snuff out the burning coal and hold the partially-smoked cigarette until the smoker wishes to relight the cigarette. Such snuffing device, which may comprise a tubular element, separate from or housed within a cigarette package constructed to receive the same in a compartment separate from the cigarettes.

When a partially-smoked cigarette is re-lit, a burnt tobacco taste and/or odour may be detected by the smoker as a result of contamination of the cigarette by gaseous or solid contaminants, which may be undesirable. An additional feature of the invention provides means to minimize such contamination.

A variety of means may be adopted for this purpose. One manner of proceeding is to provide charcoal or other odour adsorbing material in a storage container in which the partially-smoked cigarette may be stored between smokings, or otherwise associated with the package.

In addition, a device may be provided which has the means to snuff out a lit cigarette and to cut-off and/or store the charred tobacco tip of the cigarette. This cutting device may be associated with a cigarette lighter to facilitate the smoker relighting the partially-smoked cigarette.

Alternatively, a cutting device or snipper may be constructed as a stand-alone item to be employed to cut off the charred tip of the cigarette to prepare the partially-smoked cigarette for resmoking.

EXAMPLES

In a series of experiments, cigarettes, wrapped in KC119 paper, were constructed in accordance with the present invention in three standard cigarette lengths and were compared, first, to typical conventional cigarettes and, second, to cigarettes constructed from the same blend as the conventional cigarettes at approximately the same draw resistance as the cigarettes constructed in accordance with the invention, also wrapped in KC119 paper. These cigarettes were tested for a variety of parameters and the results obtained are reproduced in the following Table:

TABLE

| | 72 mm | | | 84 mm | | | 100 mm | | | | |
|---|---|---|---|---|---|---|---|---|---|---|---|
| | I* | C* | D* | I | C | D | I | $I_2$ | $I_3$ | C | D |
| Tobacco rod length (mm) | 55 | 55 | 55 | 64 | 64 | 64 | 74 | 74 | 74 | 74 | 74 |
| Tobacco rod diameter (mm) | 7.99 | 7.95 | 8.01 | 7.99 | 7.95 | 7.98 | 7.97 | 7.97 | 7.93 | 7.89 | 7.97 |
| Tobacco wt. (mg) | 909 | 689 | 708 | 1062 | 736 | 797 | 1142 | 1458 | 1333 | 850 | 921 |
| Tobacco rod density (mg/cc) | 330 | 244 | 255 | 331 | 232 | 245 | 314 | 395 | 365 | 235 | 253 |
| Cigarette rod draw resistance (cm $H_2O$) | 8.9 | 8.7 | 7.9 | 9.2 | 10.5 | 9.0 | 9.5 | 17.1 | 13.7 | 9.8 | 9.8 |
| Tobacco rod draw resistance (cm $H_2O$) | 7.9 | 6.0 | 6.5 | 8.1 | 6.0 | 7.5 | 7.8 | 21.4 | 16.3 | 7.9 | 8.2 |
| Tobacco | 3.29 | 4.79 | 4.77 | 3.15 | 5.17 | 4.72 | 3.35 | 2.26 | 2.58 | 5.41 | 4.89 |

TABLE-continued

| | 72 mm | | | 84 mm | | | 100 mm | | | | |
|---|---|---|---|---|---|---|---|---|---|---|---|
| | I* | C* | D* | I | C | D | I | $I_2$ | $I_3$ | C | D |
| rod free burn rate (mm/min) | | | | | | | | | | | |
| Cigarette linear burn rate (mm/min) | 3.31 | 5.66 | 5.22 | 3.35 | 5.65 | 5.23 | 3.69 | 2.53 | 2.82 | 5.65 | 5.37 |
| Puffs | 14.2 | 8.3 | 9 | 16.7 | 9.8 | 10.7 | 17.9 | 26.1 | 23:4 | 11.7 | 12.3 |

*I = inventive cigarette
C = conventional cigarette
D = conventional cigarette blend to same cigarette draw resistance, wrapper, filter and dilution as inventive cigarette
$I_2$ = inventive cigarette blend with same format as I (100 mm) except with higher tobacco density
$I_3$ = inventive cigarette blend with same format as I (100 mm) except with higher tobacco density As may be seen from this data, the commercial cigarettes constructed in accordance with the invention exhibited puff counts for each of the three lengths used in excess of those exhibited by the cigarettes of the same length to which the comparison was made. The free burn rates of the tobacco rod in the cigarettes of the invention are, for each cigarette length, below 3.5 mm/min., while those for the comparative cigarettes were all well in excess of that value.

SUMMARY OF DISCLOSURE

In summary of this disclosure, the present invention provides a novel commercial cigarette structure having more than the normal number of puffs, preferably double, and appropriate accessories which, individually or together, permit the novel cigarettes to be partially smoked, extinguished, stored and re-smoked with approximately the same delivery of tar, nicotine and flavour characteristics, while minimizing the adverse effects of extinguishing and then re-lighting a cigarette, or smoked as one long-lasting cigarette. Modifications are possible within the scope of the invention.

What we claim is:

1. A non-self-extinguishing factory-made cigarette which has at least about 2 more puffs (as determined by I.S.O. #3308 and 4387 Standards) than the median number of puffs of a conventional cigarette of the same dimensions of length and diameter of tobacco rod.

2. The cigarette of claim 1 having at least about 4 more puffs than the conventional cigarette.

3. The cigarette of claim 1 having at least about 6 more puffs than the conventional cigarette.

4. The cigarette of claim 1 which has at least about 14 puffs.

5. The cigarette of claim 4 which has from about 15 to about 30 puffs.

6. The cigarette of claim 1 which has a linear burn rate of no more than about 4 mm/min. (as determined by I.S.O. #3308 and 4387 Standards).

7. The cigarette of claim 8 which comprises a tobacco rod having a free burn rate of no more than about 4 mm/min.

8. The cigarette of claim 1 which has a draw resistance which is acceptable to a smoker of the cigarette.

9. The cigarette of claim 1 which has a filter attached thereto and which has a draw resistance of less than about 20 cm $H_2O$ (as determined by I.S.O. #6565 Standard).

10. The cigarette of claim 11 having a draw resistance of about 7 to about 15 cm $H_2O$.

11. A non-self-extinguishing factory-made cigarette which has at least about 2 more puffs (as described by I.S.O. #3308 and 4387 Standards) than the median number of puffs of a conventional cigarette of the same dimensions of length and diameter of tobacco rod and which comprises a tobacco rod having a tobacco density of at least about 300 mg/cc.

12. The cigarette of claim 13 wherein said tobacco density is about 320 to about 400 mg/cc.

13. The cigarette of claim 1 which is intended to be smoked for an initial length thereof, extinguished, relit and then smoked for a further length thereof, and which is constructed to provide a per puff smoke delivery profile to the smoker which is approximately the same for smokings of the cigarette for the initial length thereof and for the further length thereof.

14. The cigarette of claim 1 which is constructed to provide a per puff smoke delivery profile to a smoker of the cigarette which exhibits a more uniform delivery of tar, nicotine and flavour to the smoker than otherwise would be the case.

15. The cigarette of claim 14 wherein said more uniform delivery of tar, nicotine and flavour is achieved by dilution of normal tobacco smoke.

16. The cigarette of claim 14 wherein said more uniform delivery of tar, nicotine and flavour is achieved by filtration of normal tobacco smoke.

17. The cigarette of claim 14 which is intended to be smoked for an initial length thereof, extinguished, relit and then smoked for a further length thereof, and which is provided with a filter constructed to provide a per puff smoke delivery profile to the smoker which is approximately the same for smokings of the cigarette for an initial length thereof and for a further length thereof.

18. The cigarette of claim 17 wherein said filter is constructed to permit a first lower level of dilution of tobacco smoke passing through the filter during said initial smoking of the cigarette and a second higher level of dilution of tobacco smoke passing through the filter during said further smoking of the cigarette.

19. The cigarette of claim 18 wherein said first lower level of dilution is from 0 to about 40% dilution of tobacco smoke and said second higher level of dilution is from about 10 to about 60% dilution of tobacco smoke.

20. The cigarette of claim 18 wherein said filter is manually adjustable between said first and second levels of dilution.

21. The cigarette of claim 14 wherein said cigarette is constructed to provide self adjustment of the level of tar, nicotine and flavour delivered to the smoker during smoking of the cigarette.

22. The cigarette of claim 1 wherein said tobacco rod is composed of flue-cured tobacco.

23. The cigarette of claim 1 which delivers a level of tar and nicotine per puff approximately that of said conventional cigarette.

24. The cigarette of claim 1 which delivers a per puff profile of tar, nicotine and flavour to a smoker as smoking progresses which is a flatter curve than that for said conventional cigarette.

25. The cigarette of claim 1 which has a tobacco rod length of at least about 40 mm and a tobacco rod circumference of about 20 to about 30 mm.

26. A non-self-extinguishing factory-made cigarette which has at least about 14 puffs (as determined by I.S.O. #3308 and #4387 Standard).

27. The cigarette of claim 26 which has about 15 to about 30 puffs.

28. The cigarette of claim 26 which comprises a tobacco rod having a free burn rate of no more than about 4 mm/min.

29. The cigarette of claim 28 which as a linear burn rate of no more than about 4 mm/min. (as determined by I.S.O. #3308 and 4387 Standard).

30. The cigarette of claim 26 which comprises a tobacco rod having a tobacco density of at least about 300 mg/cc.

31. The cigarette of claim 30 whenever said tobacco density is about 320 to about 400 mg/cc.

32. The cigarette of claim 26 which has a filter attached thereto and which has a draw resistance of less than about 20 mm $H_2O$ (as determined by I.S.O. #6565 Standard).

33. The cigarette of claim 32 having a draw resistance of about 7 to about 15 cm $H_2O$.

34. A non-self-extinguishing factory-made cigarette which has at least about 2 more puffs (as determined by I.S.O. #3308 and 4387 Standards) than the median number of puffs of a conventional cigarette of the same dimensions of length and diameter of tobacco rod and which comprises a tobacco rod having a free burn rate of no more than about 4 mm/min. (as determined by I.S.O. #3612 Standard).

35. The cigarette of claim 34 wherein said tobacco rod has a free burn rate of no more than about 3.5 mm/min.

36. A non-self-extinguishing factory-made which has a filter attached thereto and which comprises a tobacco rod, wherein said cigarette has a draw resistance of less than about 20 cm $H_2O$ (as determined by I.S.O #6565 Standard) and a linear burn rate of no more than about 4 mm/min. (as determined by I.S.O. #3308 and 4387 Standard) and said tobacco rod has a tobacco density of at least about 300 mg/cc and a free burn rate of no more than about 4 mm/min. (as determined by I.S.O. #3612 Standard).

37. A non-self-extinguishing factory-made which comprises a tobacco filler rod surrounded by a wrapper and which has at least about 2 more puffs (as determined by I.S.O. #3308 and 4387 Standard) than the median number of puffs of a conventional cigarette of the same dimensions of length and diameter of tobacco rod and wherein said wrapper has a burn rate corresponding to that of a single cigarette paper wrapper having a porosity of about 5 to about 50 Coresta Units.

38. The cigarette of claim 37 wherein said wrapper comprises a single cigarette paper wrapper having a porosity of about 5 to about 20 Coresta Units.

39. The cigarette of claim 37 wherein said wrapper comprises a multiple cigarette paper wrapper having a burn rate corresponding to that of a single cigarette paper wrapper having a porosity of about 5 to about 20 Coresta Units.

40. A non-self-extinguishing factory-made cigarette which has about 15 to about 30 puffs (as determined by I.S.O. #3308 and 4387 Standard), linear burn rate of no more than about 4 mm/min. (as determined by I.S.O. #3308 and 4387 Standard), a filter attached thereto and a draw resistance of about 7 to about 15 cm/$H_2O$ (as determined by I.S.O. #6565 Standard) and which comprises a tobacco rod having a free burn rate of no more than about 3.5 mm/min. (as determined by I.S.O. #3612 Standard) and a tobacco density of about 320 to about 400 mg/cc.

41. The cigarette of claim 40 wherein said tobacco rod is composed of flue-cured tobacco.

42. A non-self-extinguishing factory-made cigarette which has about 15 to about 30 puffs, (as determined by I.S.O. #3308 and 4387 Standard) a linear burn rate of no more than about 4 mm/min. (as determined by I.S.O. #3308 and 4387 Standard) and which comprises a tobacco rod having a free burn rate no more than about 4 mm/min. (as determined by I.S.O. #3612 Standard) and a tobacco density of at least about 300 mg/cc.

43. The cigarette of claim 42 which has a fighter attached thereto and which has a draw resistance of less than about 20 cm $H_2O$.

44. The cigarette of claim 43 wherein said filler rod is surrounded by a wrapper and said wrapper has a burn rate corresponding to that of a single paper wrapper having a porosity of about 5 to about 50 Coresta Units.

45. The cigarette of claim 44 wherein said porosity is from about 5 to about 20 Coresta Units.

46. A non-self-extinguishing factory-made cigarette comprising a tobacco rod enclosed within a paper wrapper and a filter at one end and having the following combination of parameters:

a draw resistance of less than about 20 cm $H_2O$, and a free burn rate of blend in said tobacco rod of no more than about 4 mm/min.

47. The cigarette of claim 46 wherein said free burn rate is no more than about 3.5 mm/min.

48. The cigarette of claim 46 having a tobacco density in said tobacco rod of at least about 300 mg/cc.

49. The cigarette of claim 48 wherein said tobacco density is from about 320 to about 400 mg/cc.

50. The cigarette of claim 46 which has a linear burn rate of no more than about 4 mm/min.

51. The cigarette of claim 46 which has at least about 4 puffs.

52. The cigarette of claim 51 which has about 15 to about 30 puffs.

53. The cigarette of claim 46 having a tobacco density of at least about 300 mg/cc and a linear burn rate of no more than 4 mm/min.

54. The cigarette of claim 46 which has a draw resistance of about 7 to about 15 cm $H_2O$.

55. The cigarette of claim 54 which has from about 15 to about 30 puffs.

56. The cigarette of claim 46 wherein said paper wrapper has a burn rate corresponding to that of a single cigarette paper wrapper having a porosity of about 5 to about 50 Coresta Units.

57. The cigarette of claim 56 wherein said paper wrapper comprises a single cigarette paper wrapper having a porosity of about 5 to about 20 Coresta Units.

58. The cigarette of claim 46 wherein said filter is constructed to provide a smoke delivery profile to a smoker of the cigarette which exhibits a more uniform delivery of tar, nicotine and flavour to the smoker than in the absence of such filter.

59. The cigarette of claim 58 which is intended to De smoked for an initial length thereof, extinguished, relit and then smoked for a further length thereof, and wherein said filter is constructed to provide a smoke delivery profile to the smoker which is approximately the same for both smokings of the cigarette.

60. The cigarette of claim 46 wherein said tobacco rod comprises flue-cured tobacco.

61. The cigarette of claim 46 which delivers a profile of tar, nicotine and flavour to a smoker as smoking progresses which is a flatter curve than that for a conventional cigarette of the same dimensions of length and diameter of tobacco rod.

62. A non-self-extinguishing factory-made cigarette comprising a tobacco rod enclosed within a single cigarette paper wrapper and a filter at one end and having the following combination of parameters:

a resistance to draw of less than about 15 cm $H_2O$;

a tobacco density in said tobacco rod of about 320 to about 400 mg/cc;

a free burn rate of blend in said tobacco rod of less than about 3.5 mm/min;

a linear burn rate of cigarette of less than about 4 mm/min;

a circumference of about 23 to 27 mm;

a tobacco rod length of about 60 to 70 mm;

about 16 to about 18 puffs;

and wherein said single cigarette paper wrapper has a porosity of about 5 to about 20 Coresta Units.

63. The cigarette of claim 62 wherein said tobacco rod is composed substantially of flue-cured tobacco.

64. The cigarette of claim 62 wherein said filter is constructed to permit manual adjustment of filter elements relative to one another between two positions, a first of which provides a first lower level of ventilation by air of tobacco smoke passing through the filter from a lit tobacco rod to a smoker, while said cigarette is smoked for an initial length thereof, and a second of which provides a second higher level of ventilation by air of tobacco smoke passing through the filter from the lit tobacco rod to a smoker, while said cigarette is smoked for a further length thereof, and intermediate levels of ventilation between said positions whereby tar, nicotine and flavour reaching the smoker possess approximately the same profile during both the initial and further smokings of the cigarette.

65. The cigarette of claim 64 wherein said first lower level of ventilation is from 0 to about 40% ventilation of tobacco smoke and said second level of ventilation is from about 10 to about 60% ventilation of tobacco smoke.

* * * * *